US011889902B2

(12) United States Patent
Trinkaus et al.

(10) Patent No.: US 11,889,902 B2
(45) Date of Patent: Feb. 6, 2024

(54) LOOP ELEMENT OF HOOK/LOOP FASTENER AND METHOD OF MAKING SAME

(71) Applicants: Jan Michael Trinkaus, Euskirchen (DE); Kristin Wendt, Guesten (DE)

(72) Inventors: Jan Michael Trinkaus, Euskirchen (DE); Kristin Wendt, Guesten (DE)

(73) Assignee: NITTO ADVANCED FILM GRONAU GMBH, Gronau (DE)

( * ) Notice: Subject to any disclaimer, the term of this patent is extended or adjusted under 35 U.S.C. 154(b) by 66 days.

(21) Appl. No.: 17/334,039

(22) Filed: May 28, 2021

(65) Prior Publication Data

US 2021/0368948 A1 Dec. 2, 2021

(30) Foreign Application Priority Data

May 29, 2020 (DE) ..... 102020114549.7

(51) Int. Cl.

| | |
|---|---|
| ***A44B 18/00*** | (2006.01) |
| ***A44B 13/00*** | (2006.01) |
| ***D04H 1/541*** | (2012.01) |
| ***D04H 3/153*** | (2012.01) |
| ***D04H 3/007*** | (2012.01) |

(52) U.S. Cl.

CPC ..... *A44B 13/0005* (2013.01); *D04H 3/007* (2013.01); *D04H 3/153* (2013.01); *D10B 2321/02* (2013.01)

(58) Field of Classification Search

CPC . A44B 18/0003; A44B 13/0011; A44B 13/00; A44B 13/0005; D04H 3/153; D04H 1/541

See application file for complete search history.

(56) References Cited

U.S. PATENT DOCUMENTS

| | | | | |
|---|---|---|---|---|
| 5,858,515 | A | 2/1999 | Stokes | |
| 8,152,788 | B2 * | 4/2012 | Beckert | A61F 13/51401 604/385.03 |
| 2008/0305297 | A1 * | 12/2008 | Barker | D04H 11/08 428/92 |
| 2012/0231208 | A1 * | 9/2012 | Ducauchuis | B29C 66/69 118/68 |
| 2015/0107063 | A1 * | 4/2015 | Baldauf | B32B 5/26 24/449 |

(Continued)

*Primary Examiner* — Joanna Pleszczynska

(74) *Attorney, Agent, or Firm* — Andrew Wilford

(57) ABSTRACT

A hook-and-loop fastener has a hook element comprising a substrate having a face from which projects a multiplicity of hooks and a loop element formed by of a fiber web. The fiber web is formed by a homogenous mixture of first multicomponent filaments each formed by a high-melting-point polymer and a low-melting-point polyolefinic polymer and second polyolefinic monocomponent filaments. The first filaments constitute between 20% and 80% by weight of the mixture. The fiber web has a face formed with a patterned array of dense bonded regions of a predetermined small thickness interspersed with less dense open regions of a predetermined big thickness substantially greater than the small thickness of the small thickness interspersed with less dense open regions of a predetermined big thickness substantially greater than the small thickness of the bonded regions so that the filaments of the open regions form loops.

21 Claims, 4 Drawing Sheets

(56) References Cited

U.S. PATENT DOCUMENTS

2017/0231330 A1* 8/2017 Uchida ..... B32B 5/26
24/451
2019/0000696 A1* 1/2019 Morishita ..... D04H 1/5412

* cited by examiner

LOOP ELEMENT OF HOOK/LOOP FASTENER AND METHOD OF MAKING SAME

FIELD OF THE INVENTION

The present invention relates to a hook-and-loop fastener. More particularly this invention concerns the loop element of such a fastener.

BACKGROUND OF THE INVENTION

A standard hook-and-loop fastener has hook element with a normally textile substrate having a face formed with a multiplicity of hooks and a loop element with another normally textile substrate having a face formed with a multiplicity of loops releasably engageable with the hooks. Both elements are typically made as strips or tapes extending in a longitudinal or machine direction and in a transverse direction perpendicular thereto, and have a thickness measured perpendicular to the plane of the longitudinal and transverse directions.

Pressing the two faces together engages the hooks with the loops and forms a connection that is significantly resistant to undoing by shearing forces in the longitudinal or transverse directions, but easily separated by a "peeling" movement in the thickness direction that elastically deforms of the hooks to disengage them from the loops.

A large field of application for such hook-and-loop fasteners is that of personal hygiene articles, in particular disposable diapers and incontinence articles. A major advantage of the hook-and-loop system is here the fact that it can be loosened and reattached several times. The holding properties are retained regardless of any soiling from care products such as creams, baby oil, or other liquids. Practical economic use for such a disposable mass-production item requires that the material and manufacturing costs be kept as low as possible.

However, the structured textiles such as loop knitted fabrics used to form the loop element are expensive to manufacture. In such a fastener, individual fibers or filaments are often damaged and/or pulled out when the hook tape is detached from the loop face. This makes the holding force of the hook-and-loop fastener deteriorate significantly in some cases.

Hence nonwovens are frequently used as the loop element of a hook-and-loop fastener. Nonwovens are formed from a loose, disordered fiber composite, also known as a nonwoven or fiber web, which is consolidated to form a reasonably coherent textile. Various consolidation methods are known, which on the one hand entail a physical-mechanical entanglement of the individual fibers and/or on a chemical or physical-thermal bonding of the filaments. Unlike structured—knitted or woven—textiles, when nonwovens are used they have the above-cited problem that the loops detach when undoing the fastener, causing its holding power to lessen with each use.

What is more, the fibers or filaments of a nonwoven are connected together at random location, so there is a tradeoff between making a rugged nonwoven that has few hookable loops, or making a more open nonwoven that is easily pulled apart. In addition a well consolidated nonwoven is hard to penetrate with the hooks or barbs of the hook element, while a relatively loose nonwoven has an often unfinished or rough appearance.

OBJECTS OF THE INVENTION

It is therefore an object of the present invention to provide an improved nonwoven suitable for use as the loop element of a hook-and-loop fastener.

Another object is the provision of such an improved nonwoven suitable for use as the loop element of a hook-and-loop fastener that overcomes the above-given disadvantages, in particular that is nice-looking, relatively rugged, and still presents a surface that readily receives and interlocks with the hooks of the hook element of the fastener.

A further object is to make such a loop-element nonwoven that can be produced easily and inexpensively.

SUMMARY OF THE INVENTION

According to the invention a hook-and-loop fastener has a hook element comprising a substrate extending generally in a plane and having a face from which projects a multiplicity of hooks and a loop element comprised of a fiber web extending in a longitudinal direction and a transverse direction perpendicular thereto, and having a thickness measured transversely to a plane of the directions. The fiber web is formed by a homogenous mixture of first multicomponent filaments each formed by a high-melting-point polymer and a low-melting-point polyolefinic polymer and second polyolefinic monocomponent filaments. The first filaments constitute between 20% and 80% by weight of the mixture. The fiber web has a face formed with a patterned array of dense bonded regions of a predetermined small thickness interspersed with less dense open regions of a predetermined big thickness substantially greater than the small thickness of the bonded regions so that the filaments of the open regions form loops.

Thus the invention is based on a nonwoven in which the fiber web has a plurality of synthetic-resin filaments and the nonwoven layer (in the longitudinal and transverse direction) a pattern of open regions for the engagement of hooks of a hook-and-loop fastener and the surrounding open regions and bonded regions having a reduced thickness. Although the fiber web also solidifies into a nonwoven layer in the open regions is, a lesser bond between the individual fibers is sufficient because the fibers are firmly interconnected in the bonded regions to one another. This allows the hook element to better meet the requirements of a hook-and-loop fastener.

In particular, in the bonded regions at least 75% of the filaments are typically bonded together, normally by welds where the filaments cross and engage one another. The web is compressed to a smaller thickness in the connected regions. The open regions, however, have a larger volume ("bulk") or thickness and are therefore "open-pored" so as to accommodate hooks of the hook tape. Because of the scattered alignment of the individual synthetic-resin filaments within the fiber web, individual fibers in the majority of cases are rarely anchored in at least one open region at one end and at least one bonded region at the opposite end. Such generic nonwovens are known from the prior art, for example from U.S. Pat. No. 5,858,515. Despite the patterned bonding of this nonwoven, the state of the art always has to trade off a sufficient adhesive force of the hook-and-loop fastener and the security the nonwoven fibers against tearing on the one hand against other properties of the nonwoven.

If possible, this material of the loop element should be breathable and at the same time be air-permeable and at least visually create a pleasantly "fluffy" impression and offer sufficient engagement surface for locking hooks. Added to this is the constant endeavor that to reduce material and manufacturing costs and to simplify the production process.

Multicomponent filaments, in particular bicomponent filaments with a high melting point and a low-melting-point polymer have advantages in processing and the properties of the final product. On the one hand, the high-melting polymer element contributes a good structural integrity of the fiber web both during processing and in the finished product. At the same time, the low-melting-point polymer does not reach such high temperatures during processing as would be necessary to the high melting point element at least to melt it. The thermal setting steps are based on that inventive nonwoven preferably exclusively on for example melting of the low-melting-point polymer.

The overall use of multicomponent filaments is cost-intensive, as they also require, in addition to an additional starting material, a more complex manufacturing process. To lower manufacturing costs with comparable product and processing properties, the invention provides an additional polyolefinic fiber element together with the provided multicomponent filaments in a homogeneous filament mixture. Surprisingly the second filaments also improve the supporting properties of the high-melting first polymer of the first filaments. This is enough to ensure a sufficiently airy thickness in the open regions. This can be done contrary to intuition also by adding a low-melting-point monofilament from the third polymer. At the same time, the polyolefinic third polymer contributes to particularly good bond strength in the bonded regions. The first polymer is in particular a non-polyolefinic plastic. The bending stiffness of such a non-polyolefin is usually significantly higher than that of polyolefins. This leads to a voluminous fiber structure. Crimping or curling by bending the filaments is therefore not necessary.

According to a variant of the invention, the filament mixture comprises third filaments in addition to with the first filaments and the second filaments and with different chemical and/or physical properties. This in particular influences other properties of the nonwoven. For example, the third filaments can be made finer (lower filament titer) than the first filaments and the second filaments. This leads to reduced air permeability. The third filaments are preferably made of one polyolefinic plastic.

The multicomponent filaments, especially the bicomponent filaments of the first filaments can in particular as core/sheath filaments or double side-by-side filaments. Also asymmetric multicomponent filament types are possible. In the case of core-sheath filaments, the low-melting-point second polymer is on the outside.

In particular, the multicomponent filaments are 50 to 75% by weight of the first polymer and from 25 to 50% by weight of the second polymer. Particularly good results can be achieved within the scope of the invention with bicomponent filaments and a mixing ratio of 65% to 35%, 60% to 40% or even 50% to 50%.

According to a preferred embodiment of the invention, the fiber web is 30 wt % to 50 wt % formed from the first filaments. Even a minor proportion of costly multicomponent filaments of 30% is enough to produce the desired properties in the fiber web. The proportion of the multicomponent filaments can therefore also be under half or even under one-third compared to the monofilaments.

The first filaments and the second filaments and possibly a third and further filament elements can each be formed crimped and/or smooth filaments. According to an embodiment of the invention, the filament mixture consists exclusively of the first formed fiber element and the second filaments. Other aggregates—binders in particular—are not required. A mulitlayer structure is also unnecessary, because the desired structural properties are already achieved with a uniform filament mixture. The second polymer and/or preferably the third polymer selected from the group of polypropylene (PP), polypropylene copolymers, polyethylene (PE) or polyethylene copolymers. PE, PP and theirs copolymers are inexpensive and easy to process polyolefins. These are characterized by their easily controllable melting behavior. At the same time, they have good strength and durability at room temperature.

Preferably, the first, second and/or third polymers can be recycled raw material at least as used as an admixture. To change material properties in a targeted manner—for example the bond strength of the first polymer in the multicomponent filament, blends of the above-described substances, in particular mixtures of polyethylene and its copolymers or polypropylene and its copolymers as the second and/or third polymer may be used. In general, the first polymer, the second polymer and/or the third polymer can have up to 5% aggregate. However, the polymers are particularly preferably technically pure otherwise. According to a particularly preferred embodiment of the invention, both the second and third polymers are of the same material.

This improves the composite adhesion of filaments of the first filaments with filaments of the second filaments. Since the polymers have similar chemical and physical properties, so with thermal processing they melt together and weld together in at least partially melted condition particularly well with one another. In a particularly preferred embodiment, the second polymer and that third polymer are mainly the same.

In particular, the formulations of the second polymer and the third are polymers as far as possible—with the exception of admixtures of no more than 10% by weight—are identical with regard to the basic chemical chain structure. The second, polymer and the third polymer can differ in terms of the polymerization process, the degree of branching, the proportion of metallocene polyolefins and/or the density. However, they are particularly preferably identical.

Regardless of the specific choice of material, it is particularly preferred that the melting point of the second polymer and the melting point of the third polymer are not separated by more than 5 K. This allows the second polymer in the first filaments and the third polymer in the second filaments to be melted to a similar extent by a certain temperature during processing. In order to ensure easy processing even with filament formation the second polymer and the third polymer have a melt-flow index of at least 20 g/10 min, preferably at least 25 g/10 min and have less than 500 g/10 min, in particular less than 100 g/10 min. This means that the filament formation guarantees sufficient fluidity. At the same time the second polymer and the third polymer can during thermal solidification with targeted temperature control be partially melted such that they adhesively adhere together without the filaments or fibers thereby losing its structure.

According to ISO 1133 in particular, the melt-flow index is preferably selected depending on the material test temperature (190° C. especially for PE, 230° C. especially for PP, 280° C. especially for PET) and test weight (2.16 kg). It is particularly preferred that this first polymer has polyethylene terephthalate (PET) as the main element. In particular the first polymer is formed entirely from polyethylene terephthalate. This polyester has high mechanical stability and can be particularly well combined with polyolefins in multicomponent filaments.

A particularly preferred material in the scope of the invention is polyethylene terephthalate/polypropylene bicomponent filament in connection with a polypropylene monofilament. Polypropylene has higher mechanical stability than polyethylene. At the same time is separation of the melting points is large enough to allow for a targeted melting of the polypropylene elements during processing to allow unchanged PET proportions.

Another in and of itself more inventive aspect of the present invention regards—regardless of the specific material selection—the consolidated fiber web in the open regions. This additional second aspect of the invention addresses the problem that hook faces formed from nonwoven fabric often only have inadequate adhesive force, especially against shear stresses. In the context of the additional aspect of the invention, this is made possible by the suitable selection of the fiber web properties. Especially this aspect develops a nonwoven as previously described.

According to an additional aspect of the invention the fiber web in the open regions has a filament (bulk) density between $1\times10^{10}$ (10 billion) filaments/$m^3$ and $1.5\times10^{10}$ (15 billion) filaments/$m^3$. The filament density is particularly preferably between 11 and 13 billion fibers (1.1 to $1.3\times10^{10}$) per cubic meter. The second aspect of the invention is based on the discovery that precisely this parameter has an essential significance for the adhesive properties of hooks of a hook tape in the inventive nonwoven.

The filament density ($\rho_{finrt}$), that is the number of fibers per cubic meter, is determined by adding the number ($n_{fiber}$) of the filaments to a reference volume (v)–surface area (A) times height (h) in proportion, thus:

$$\rho_{fiber}=N_{fiber}/V=N_{fiber}/(A*h)$$

The number of filaments is calculated from the ratio of the total filament length (l) to the (average) individual filament length ($l_{fiber}$), whereby the total filament length (l) is calculated according to its weight ($c_i$) relative to the mean value of the ratios of the surface density ($\rho_A$) of the nonwoven calculated for the filament titers ($Tt_i$) of the individual filament elements:

$$N_{Fiber} = \frac{L}{l_{Fiber}} = \frac{A \cdot p_A}{l_{Fiber}} \sum_i \frac{c_i}{Tt_i}$$

The height (h) of the observed volume can be determined by the spacing between the rollers during the manufacturing process. The following results for the bulk height are:

$$h_{Bulk} = \frac{\rho_A\left[\frac{g}{m^2}\right]}{\rho_{Fiber}\left[\frac{1}{m^3}\right] \cdot l_{Fiber}\left[\frac{1}{\text{mm}}\right]} \sum_i \frac{c_i[\%]}{Tt_i\left[\frac{g}{10.000\text{ m}}\right]}$$

Starting from the remaining requirements in this way, the framework conditions can be set as desired in the filament density according to the invention.

Usually, nonwovens and nonwoven products are mainly characterized according to surface density, i.e. the mass existing per unit of surface area. This parameter however alone is an unsuitable measure of the quality of a hook face in terms of mechanical holding ability. The surface density alone is not relevant to how the existing mass is spatially distributed. This parameter is also not in relation to the lengths of the individual fibers or filaments, which for their integration (via the bonded regions) is significant.

The second inventive aspect is based on the discovery that the parameter that is essential for hook engagement is the filament density consists of individual fleece filaments per unit of volume. It has been shown that a variation of the other parameters results in comparable holding forces with the same filament density. For example, in an existing process, the surface density, the filament length and the fineness of the filaments are specified based on external boundary conditions. The invention then teaches adjusting the thickness of the open regions (bulk) so that a filament density is set in the region according to the invention in the nonwoven.

Experiments by applicant have shown that in this parameter range—with other variable parameters—a particularly good hook engagement force can be achieved. Especially this works preferably when the fiber web has an average fineness (titer) of 1 dtex up to 8 dtex, in particular 1.3 dtex to 6.7 dtex. In so doing, titers of greater than 2 dtex, in particular 2.2 dtex to 6.7 dtex, are used when good air permeability and breathability are required. A certain air permeability is also required if the material is exposed to negative pressure in the manufacturing process. In the event that the nonwoven also must also limit throughflow of air and/or water vapor, a lower filament titer between 1.3 dtex and 1.9 dtex must be used.

The nonwoven preferably has a weight per unit of surface area between 30 and 60 g/$m^2$, in particular between 35 and 45 g/$m^2$ (grams per square meter, gsm). In this range there can already be sufficient mechanical stability and adhesive force.

The fiber web preferably has average filament lengths between 35 mm and 75 mm, in particular 38 mm to 72 mm. Due to the fine structures, an average filament length is preferably between 40 mm and 50 mm.

The filaments of the filament mixture—in particular the first filaments and/or the second filaments—can preferably be of noncircular cross section—in particular a trilobal cross-section. As a result, the desired filament density can be achieved due to the higher rigidity at the same titer (dtex) and with a lower surface density.

Further inventive aspects of development concern the pattern of the open regions and the bonded regions. In particular, these regions have an ellipsoidal shape. In a third inventive aspect the open regions at least partially form a regular pattern defined by first regions and second regions, the former being of larger area than the latter. Both the first and the second regions form convex bumps. The convex shape can hold be a particularly large number of filaments that extend from within the region into the immediately adjacent bonded region where they are fixed. This improves the integration of the individual filaments in the nonwoven. Pulling out individuals filaments when undoing the hook-and-loop fastener can thus be reduced.

According to a first variant the first regions and the second regions are formed entirely as open regions without the consolidation and bonding of the intervening bonded regions. But according to an alternative variant the first regions and/or the second regions each have a circumferential bonding line extending along the respective edge of the region. To be as large as possible the first region and the second region are of different sizes. Preferably the first region is at least twice as big as the second region. The size of the first region is particularly preferably approximately five times that of the second region. In a particularly preferred embodiment, the second region is about 1/10 of the first region. To maintain a uniform pattern in terms of appearance, the first region and the second region are preferably geometrically similar shaped. A shape that is optimized in terms of filament adhesion can also be achieved in both cases.

The first regions are particularly preferably arrayed in a grid along a first direction, in particular approximately the longitudinal direction and in one—preferably in addition perpendicular—second direction, in particular approximately in the transverse direction.

The first regions overlap in this arrangement both in the first direction and also in the second direction. This means that over the entire length and width of the nonwoven a hook engagement is made possible. Incorrect positioning of the hooks relative to the open regions thus cannot take place.

An angle α between the first direction and the longitudinal direction or between the second direction and the transverse direction is preferably not more than 5°. An angle of no more than 2°, preferably about 1.2° is particularly preferred. The grid dimension between the centers of adjacent first regions is preferably between 8 mm and 9 mm in the first direction and preferably about 8.5 mm in the second direction, preferably between 9 mm and 10 mm, in particular about 9.6 mm.

The second (smaller) regions are preferably on the same grid between the large first regions. They fill the gaps in the grid of the first regions. Particularly preferably, the first regions are ellipses with first major axes (largest diameter) and first minor axes (smallest diameter). The second regions also are ellipses with second major axes and second minor axes. The first major axes are parallel to one another and perpendicular to the second major axes of the second regions. This enables particularly parquetting of the nonwoven material with open regions can be achieved. At the same time, the elliptical shape improves filament adhesion with aligned (carded) nonwoven filaments.

The first major axes preferably have a length between 6 and 8 mm, in particular about 7 mm. The first minor axes measure preferably 4 to 8 mm, in particular 5 mm. The second major axes are preferably 2 to 4 mm, especially 2.7 mm. The second minor axes preferably measure between 1 and 2 mm, especially about 1.3 mm.

In a particularly preferred embodiment, this fiber web has a single continuous bonded region between surrounding the first regions and second regions are formed as islands forming the open regions. Appropriately adjacent first regions and second regions have a minimum spacing between 0.25 mm and 0.7 mm, in particular about 0.4 mm. Such narrowness of the bonded region is sufficient to ensure sufficient filament anchoring. At the same time, the bonded regions not participating in the hook engagement are minimized.

Another equally inventive aspect of the development concerns an alternative pattern of free regions and bonded regions. This can in particular also be combined with the previously described features of the nonwoven. According to this fourth aspect of the inventive idea the bonded regions form a line pattern. The line pattern includes a first group of parallel lines and one the second group of parallel lines inclined at an acute angle to the first group.

The lines of the first group and the lines of the second group enclose a multitude of diamond-shaped cells. Furthermore, the line pattern has at least one open elliptical arc or line in each such rhombic cell such that the elliptical arc tangentially touches all four lines enclosing the cell of the first group and the second group tangentially. The line pattern is formed from a large number of different linear bonded regions or ridges. These line-shaped bonded regions have an approximately constant width of less than 1.5 mm and a significantly larger length. In the context of the pattern according to the fourth aspect of the invention, the open regions form pillow-shaped center bumps, which are at least three-sided and c-shaped within the open elliptical arcs. In addition, the lines of the first group and the lines of the second group span a diamond-shaped network that includes and stabilizes elliptical arcuate line parts. Furthermore, the elliptical open regions lying outside the elliptical arcs are subdivided by the lines running therein and stabilized. Due to the tangential connection of the elliptical arc, they snugly close and stabilize the diamond pattern.

Preferably the lines of the first group are and/or the lines of the second group are not continuous, so that they do not touch one another, but almost meet end to end. In particular the bonded regions are recessed at corners of the diamond shaped cells, at the "intersections" where the lines of the first group and the lines of the second group meet, so that there is also an open region there. Thus, the diamond-shaped cells also have a grid of open regions that are surrounded by the bonded regions. In this case, the bonded line regions also form a continuous pattern over the entire textile web of the nonwoven.

According to all aspects of the present invention, preferably the bonded regions occupy at least 15% and 30%, in particular between 20% and 25%, of the area of the fiber web. Especially with elliptical pillow-like bumps as the open regions, from an open elliptical arch closed by straight lines or completely elliptical, it can be seen mathematically that with proportion of 20% bonded regions there is a strong probability that most of the synthetic-resin filaments are embedded in the bonded regions and thus anchored against pulling out of the nonwoven. This is the optimal compromise between as large an open region as possible and securing all filaments.

The scaling of the pattern is preferably chosen so that the randomly arrayed fibers or filaments of the open regions are more likely to be bonded at both ends in bonded regions. It has been shown that a separate consideration in the longitudinal direction (machine direction) and the transverse direction are sufficient to ensure the pull-out resistance and make the adhesive properties predictable. It is also sufficient to exclusively consider the largest open regions in each case.

As an estimate of the probability that a certain filament aligned in the longitudinal or transverse direction is only anchored at one end, can be considered to be the ratio of the extension (u) of the open region in this longitudinal or transverse direction at an observed point (x) to the filament length ($l_{filament}$). From this, the probability ($P_{anchored}$) of a bound filament (on a certain place) is:

$$P_{anchored}(x)=1-u(x)/l_{fiber}$$

A particularly good filament adhesion results in both the longitudinal direction as well as in the transverse direction averaged over the entire open region for an anchoring probability $P_{anchored}$ of at least 70%, preferably at least 80%. In particular, the minimum local anchoring probability min $P_{anchored}$ (x) both in the longitudinal and in the transverse direction is greater than 70%, especially greater than 80%.

Another independently inventive aspect of the present development lies in the method of making the nonwoven. This allows in particular the manufacture of the above-described nonwoven according to at least one aspect of the invention. In the context of the inventive concept, a fiber web is first formed and subsequently thermally preconsolidated. It is essential to the invention that for preconsolidation both air-through-bonding and thermal calendering are used. Both consolidation processes are usually in exclusive competition with one another, that is are used alternatively to one another, never together. The inventive idea is that different consolidation systems are applied to the above-described web made of multicomponent filaments and low-melting-point monofilaments. Air-through-bonding is a heated air flow through the fiber web perpendicular to the machine and transverse directions, the heated air having a temperature that is targeted to not melt and soften one of the components of multicomponent filaments. Thus the Air-through-bonding temperature is such that the filaments only melt and soften on their outer surfaces so that the random points of contact of the filaments weld together on cooling.

The actual size and shape of the fiber web is not affected by this Air-through-bonding process. In particular, a fiber web that is loose after filament deposition remains voluminous and airy. The Air-through-bonding treatment of a fiber web patterned is particularly effective on its open regions. This is where the airy structure comes through the Air-through-bonding treatment strengthened and preserved.

The second solidification treatment, namely the thermal calendering, involves rolling the nonwoven with a structured and heated profile roller. As an alternative to thermal calendering, similar structuring processes, such as ultrasonic bonding, can also be used. Due to the thermal calendering, the fiber web is compressed in certain regions and the heated and partially melted filaments are tightly pressed together. This forms the bonded regions. These anchor the filaments of the nonwoven within the nonwoven. At the same time they these consolidated or bonded regions have a low air permeability and possibility of engagement for hooks.

Air-through bonding is particularly preferred before thermal calendering. In the first consolidation Air-through-bonding step, the filaments are first loosely anchored in the fiber web to one another, so that even if compressed by the following calendering there is some elastic recovery, at least in the open regions. The targeted combination of the two consolidation processes adapts the nonwoven to the technical requirements. The open regions are made and held by the separate air-through bonding. They may be "fluffy" in this state, but show a rather "hard" haptic impression. However, this is irrelevant for the intended purpose, because there it is mainly the mechanical properties of the hook-and-loop that must be as good as possible.

The fiber web is particularly preferably carded before the thermal consolidation or cards. Through this work step the filaments of the fiber web are at least partially aligned in the machine direction. This increases the mechanical stability of the nonwoven and also increases the likelihood that all filaments are safe embedded in the bonded regions.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
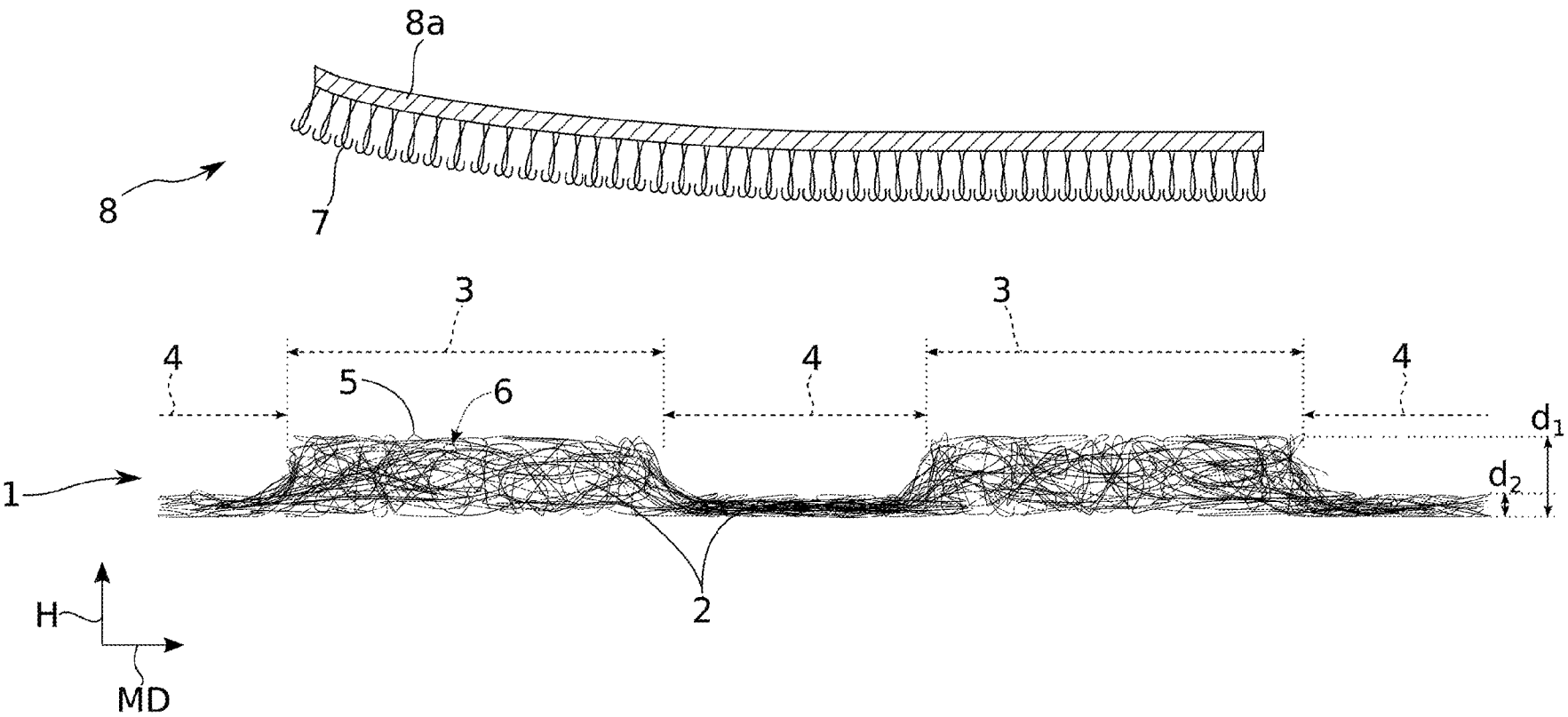
FIG. 1 is a cross section through a nonwoven according to the invention.

FIG. 1 shows a nonwoven 1 according to the invention comprised of a fiber web 2 that in accordance with the first aspect of the invention is a homogeneous filament mixture with first filaments and second filaments. The first filaments in this embodiment 50 wt % of the filament mixture and is made of a bicomponent filament with polyethylene terephthalate (PET) with a weight fraction of 60% (30% of the filament mixture, corresponding to 3.3 dtex) as the first polymer and polyethylene (PE) with a weight fraction of 40% (20% of the filament mixture, corresponding to 2.2 dtex) as the second polymer formed. The melting point of the polyolefinic polyethylene is below that of PET. Furthermore, the filament mixture contains 50% by weight (corresponding to 1.9 dtex) of one polypropylene (PP) monofilament.

The nonwoven forms a textile web extending in a longitudinal or machine direction MD and a transverse direction CD perpendicular thereto. At right angles to this web plane, the nonwoven has an overall height or thickness H formed by big and small thicknesses $d_1$ and $d_2$ that differ locally on the textile web. Thus the nonwoven layer has a pattern of open regions 3 with a big thickness $d_1$, which are surrounded by bonded regions 4 with a small thickness $d_2$.

In the bonded regions 4, the synthetic-resin filaments 5 of the batt 2 are compressed and the fibers or filaments are connected to one another by partially melting them together. Thus in the bonded regions 4, almost all of the filaments 5 there are firmly connected together at least one point within the fibrous web 2 and thus held securely.

In the open regions 3, the filaments 5 are only loosely attached at random crossing or connection points 6. These connections 6 cannot prevent the individual filaments 5 from being pulled out. However, they serve to maintain the structure of the open region 3, in particular for the formation of the preset big height $d_1$. This is selected so a given filament fineness, surface density and average filament length confer a preferred filament density of $1.2\times10^{10}$ filaments/$m^3$ in the open regions 3. These open regions 3 are used to engage hooks 7 of a hook tape 8 embedded in a substrate 8*a*. The hook tape 8 forms together with the nonwoven 1 a hook-and-loop fastener, the nonwoven 1 with the open regions 3 forming the loop face.

Figure 2:
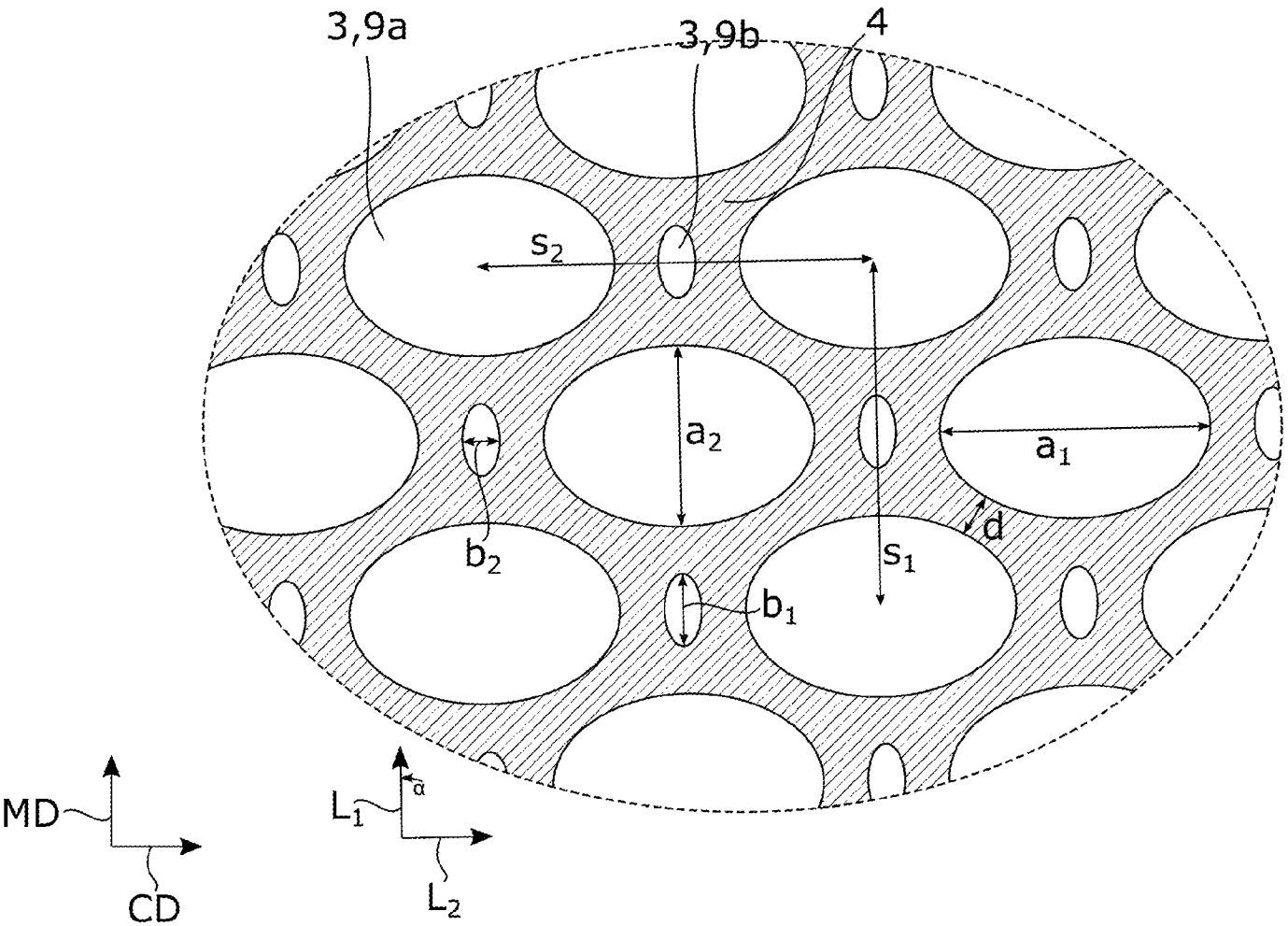
FIG. 2 shows a top view of a nonwoven according to the invention with a first pattern.

FIG. 2 shows a first possible pattern of the open regions 3 and bonded regions 4. The open regions 3 form a regular pattern of convex first regions 9*a* and convex second regions 9*b*. The first regions 9*a* are ten times greater in area than the second regions 9*b*. They are elliptical and geometrically similar to one another and arrayed in a grid along a first direction $L_1$ and in a second direction $L_2$ perpendicular thereto. The first regions 9*a* overlap in the first direction $L_1$ as well as in the second direction $L_2$. In this embodiment, there is between the first direction $L_1$ and the longitudinal direction MD and between the second direction $L_2$ and the transverse direction CD an angle $\alpha$ of 1.2°. This slight inclination can produce technical advantages, especially when manufacture uses profile rollers.

The first regions 9*a* are each elliptical and extend parallel to one another extending along respective first major axes $a_1$ of about 7 mm and first secondary axes $a_2$ of about 5 mm. The second regions 9*b* are also elliptical with second major axes $b_1$ of approximately 2.7 mm and second minor axes $b_2$ of about 1.3 mm. The major axes $a_1$ of the regions 9*a* are roughly perpendicular to the major axes $b_1$ of the regions 9*b*. The grid size of the first regions 9*a* with one another or the second regions 9*b* below one another are each (center to center) $s_2$=9.6 mm in the second direction $L_2$ and $s_1$=8.5 mm in the first direction $L_1$. In this pattern the bonded regions 4 cover an area of about 20% and the open regions the remaining area of at least 70% and preferably 80% of the web 2. The total area of only the first regions 9*a* is equal to about 70% of the total area of the workpiece 2. The minimum distance d between two adjacent first regions 9*a* or the first regions 9*a* and adjacent second regions 9*b* is about 0.4 mm.

Figure 3:
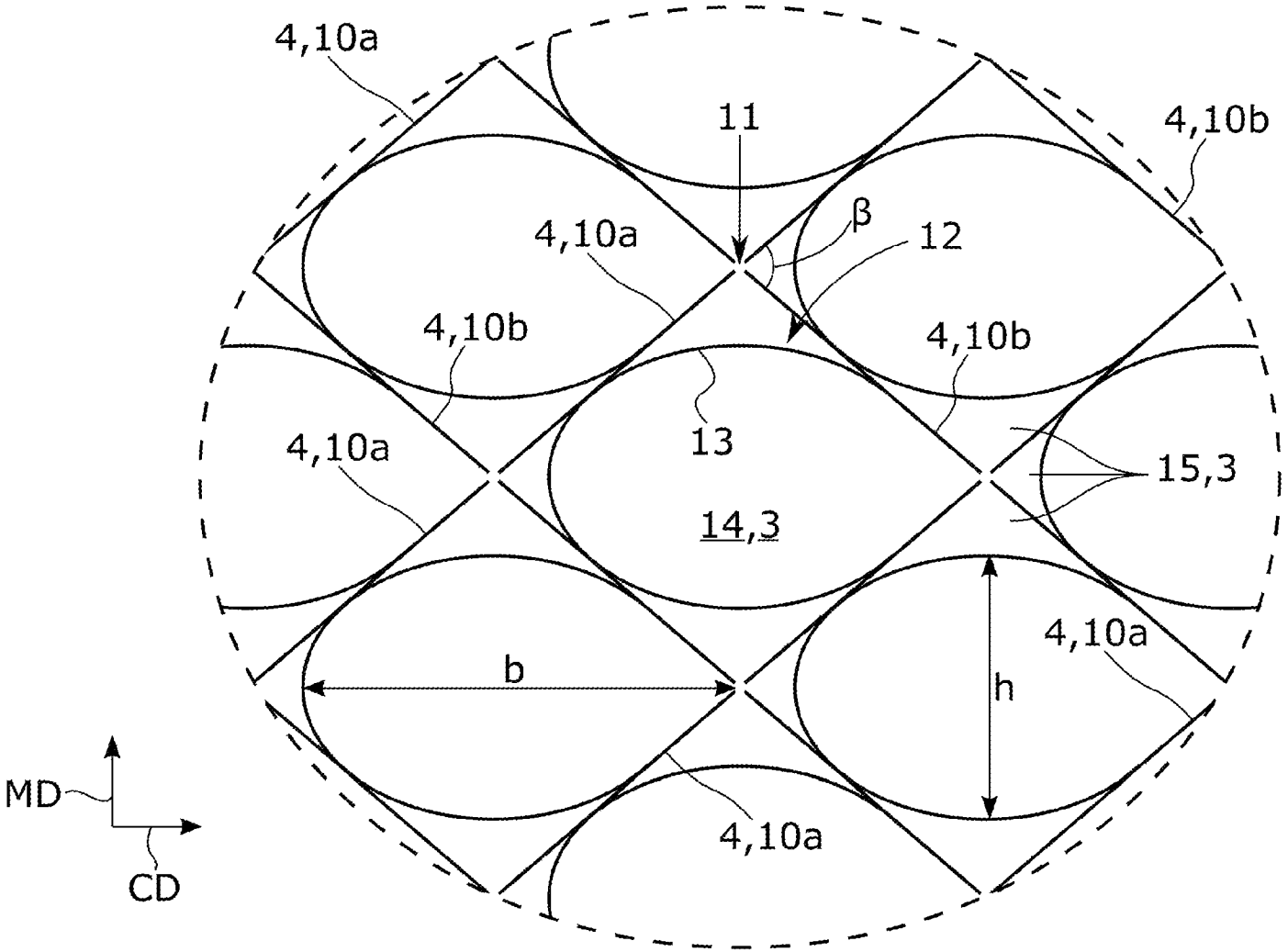
FIG. 3 is a top view of a nonwoven according to the invention with a second pattern.

FIG. 3 shows an alternative pattern in accordance with another inventive aspect of the present application. The bonded regions 4 thereby form a line pattern. The line pattern includes a first group of parallel lines 10*a* as well a second group of parallel lines 10*b* inclined at an angle β with respect to the lines of the first group 10*a*. The lines of the first group 10*a* and the lines of the second group 10*b* are interrupted in such a way as to form breaks or interruptions at the intersections 11, which are not bonded but form open regions 3.

The lines 10*a* and 10*b* are continuous other than at the intersections 10. The lines 10*a* of the first group and the lines 10*b* of the second group are each set equidistantly and form diamond-shaped or rhombic cells 12 whose corners form the intersection points 11. The sides of the rhombic cells 12 are formed by uninterrupted sections of lines 10*a* of the first group and lines 10*b* of the second group.

Each of the diamond-shaped cells 12 holds an incomplete elliptical arc 13 of the line pattern. This arc 13 touches the lines 10*a* and 10*b* defining the cells 12 tangentially. The elliptical arc 13 defines a complete quadrant between the contact points of two adjacent edge lines.

A cushion-shaped portion 14 of an open region 3 is located within the elliptical arc 13 where the lines 10*a* and 10*b* are interrupted at the intersection 11 and form regions 15 with two straight sides and an arcuate base between them. The elliptical arc 13 delimits a cushion-like region 14 of the respective open region 3, that is connected at the intersection 11 to open regions 15 outside the elliptical arcs 13 in adjacent cells 12. The major diameter b of the cushion-like section b in this example is about 12 mm. The height h of the cushion 14 is the maximum height of the elliptical arc 13, that is about 8 mm.

Figure 4:
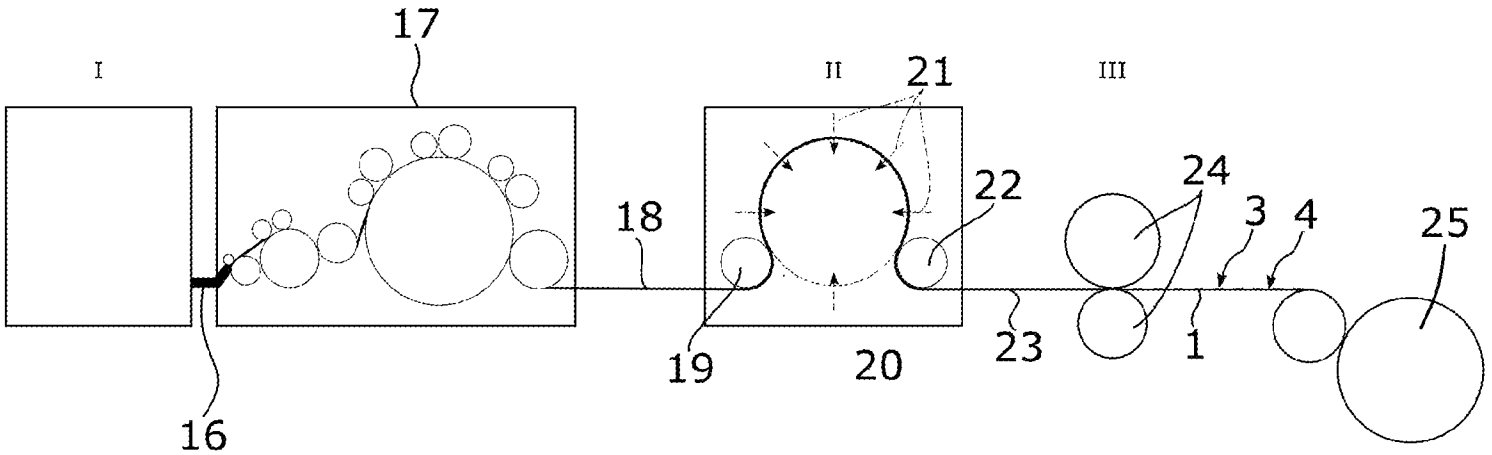
FIG. 4 shows a schematic representation of a production method according to the invention.

FIG. 4 schematically illustrates a production method according to the invention. In a first step I a filament mixture, in particular a homogeneous filament mixture of a multicomponent filament and a low-melting-point monofilament is produced. The staple fibers 16 laid in this way are initially fed to a carding machine 17 and roughly aligned there. The carded fiber web 18 is then subjected to a first thermal consolidation II by air-through-bonding. The carded fiber web 18 is transferred by a suction roller 19 to a large drum 20 into which continuous streams 21 of hot air are aspirated. The temperature of the hot air stream 21 is set such that the filaments of the fiber web 18 melt on their surface and at random contact points 6 connect with one another. Via a second roller 22, which is optionally cooled, the preconsolidated fiber web 23 is pulled off the drum 20.

Then the preconsolidated fiber web 23 is for thermally calendered at III in the nip between two rollers 24, of which at least one is profiled. The preconsolidated fiber web 23 is compressed by appropriate temperature control of the rollers 24 at least locally—in the bonded regions 4—and further consolidated. This forms the above-described pattern of open regions 3 and bonded regions 4. The pattern of the profiled rollers 24 can emboss the preconsolidated web 23 with the desired pattern. The finished nonwoven 1 can then be wound up into a roll 25.

We claim:

1. A hook-and-loop fastener comprising:

a hook element comprising a substrate extending generally in a plane and having a face from which projects a multiplicity of hooks; and a loop element comprised of a fiber web extending in a longitudinal direction and a transverse direction perpendicular thereto, having a face formed with a patterned array of dense bonded regions of a predetermined thickness interspersed with less dense open regions of a predetermined thickness substantially greater than the thickness of the bonded regions, and having a thickness measured transversely to a plane of the directions, the fiber web being formed by a homogenous mixture of first multicomponent filaments and second polyolefinic monocomponent filaments, the first filaments forming in the open regions loops and each formed by a high-melting-point first polymer and a low-melting-point second polyolefinic polymer, the first filaments constituting between 20% and 80% by weight of the homogeneous mixture, the bonded regions being arrayed in a line pattern constituted by a first group of parallel lines and second group of parallel lines extending at an acute angle to the first group of parallel lines to form a plurality of four-sided rhombic cells, the line pattern further having an open elliptically arcuate line in each of the cells tangentially engaging all four sides of the respective cell.

2. The fastener according to claim 1, wherein the first filaments constitute from 30 wt % to 50 wt % of the mixture.

3. The fastener according to claim 1, wherein the homogeneous mixture is wholly formed of the first and second filaments.

4. The fastener according to claim 1, wherein the second polymer and/or the a third polymer of the second filaments is polypropylene, a polypropylene copolymer, polyethylene, or a polyethylene copolymer.

5. The fastener according to claim 4, wherein the second and third polymers are the same polymer.

6. The fastener according to claim 4, wherein a melting point of the second polymer and a melting point of the third polymer are within 5 K of one another.

7. The fastener according to claim 4, wherein the second polymer and the third polymer have a melt flow index between 20 g/10 min and 500 g/10 min.

8. The fastener according to claim 1, in that the first polymer is polyethylene terephthalate.

9. The fastener according to claim 1 wherein the fiber web has a filament density in the open regions between $1.0\times10^{10}$ filaments/$m^3$ and $1.5\times10^{10}$ filaments/$m^3$.

10. The fastener according to claim 1, wherein the first filaments and/or the second filaments have a nonround cross section.

11. The fastener according to claim 1, wherein the fiber web has an average titer of 1 dtex to 8 dtex.

12. The fastener according to claim 1, wherein the fiber web has a surface density between 30 and 60 g/$m^2$.

13. The fastener according to claim 1, wherein the open regions are arrayed in a regular pattern and include convex first regions and convex second regions of lesser area than the first regions.

14. The fastener according to claim 13, wherein the first and second regions are of geometrically similar shapes.

15. The fastener according to claim 14, wherein the first regions are elongated in one of the directions and the second regions are elongated in the other of the directions, the first regions overlapping one another in both the one direction and the other direction.

16. The fastener according to claim 14, wherein the first and second regions are substantially elliptical and have respective first and second major and minor axes, the first major axes being parallel to one another, the second major axes being parallel to one another and generally perpendicular to the first major axes.

17. The fastener according to claim 14, wherein the bonded regions are continuous and the first and second regions are each wholly surrounded by the bonded regions.

18. The fastener according to claim 14, wherein the first and second regions are spaced in the plane from one another by a minimum of 0.25 mm to 0.7 mm.

19. The fastener according to claim 1, wherein the lines of one of the first and second groups are discontinuous and do not touch lines of the other of the first and second groups.

20. The fastener according to claim 1, wherein each of the rhombic cells holds a respective one of the open elliptically arcuate lines.

21. The fastener according to claim 1, wherein the bonded regions form between 15% and 30% of a surface area of the one face of the fiber web.

* * * * *